US007812776B2

(12) United States Patent
Guixa Arderiu

(10) Patent No.: US 7,812,776 B2
(45) Date of Patent: Oct. 12, 2010

(54) REMOTE CONTROL DEVICE FOR CONTROLLING THE ANGLE OF INCLINATION OF THE RADIATION DIAGRAM ON AN ANTENNA

(75) Inventor: Ramón Guixa Arderiu, Arganda Del Rey (ES)

(73) Assignee: Radiacion Y Microondas, S.A. (ES)

( * ) Notice: Subject to any disclaimer, the term of this patent is extended or adjusted under 35 U.S.C. 154(b) by 174 days.

(21) Appl. No.: 11/996,366

(22) PCT Filed: Dec. 19, 2006

(86) PCT No.: PCT/ES2006/070197

§ 371 (c)(1),
(2), (4) Date: Jan. 22, 2008

(87) PCT Pub. No.: WO2007/135204

PCT Pub. Date: Nov. 29, 2007

(65) Prior Publication Data

US 2008/0316133 A1 Dec. 25, 2008

(51) Int. Cl.
*H01Q 3/00* (2006.01)

(52) U.S. Cl. ..... 343/766; 343/765; 343/757; 343/759; 343/754

(58) Field of Classification Search ..... None
See application file for complete search history.

(56) References Cited

U.S. PATENT DOCUMENTS

| | | | | |
|---|---|---|---|---|
| 6,197,458 | B1 * | 3/2001 | Kato | 430/7 |
| 7,031,751 | B2 * | 4/2006 | Hurler et al. | 455/557 |
| 7,505,010 | B2 * | 3/2009 | Franzon et al. | 343/757 |
| 2005/0272470 | A1 * | 12/2005 | Hurler et al. | 455/557 |

FOREIGN PATENT DOCUMENTS

WO WO 2006057612 * 1/2006

* cited by examiner

*Primary Examiner*—Trinh V Dinh
(74) *Attorney, Agent, or Firm*—Dickinson Wright, PLLC

(57) ABSTRACT

The device permits remote actuation on the slope angle of an antenna consisting of two units, one electric and one mechanical, physically separated and connected forming a single arrangement, in which each of the units is provided with its own casing. The mechanical unit supports an electromotor coil positioning sensors, a driving gear, and a gear wheel engaged with the pinion. The electronic unit is provided with supply and communication connection terminals, an electronic circuit, a sensor for reading initial reference positioning and a casing. Both are connected by means of a cable and connector. Due to the independent manner in which the mechanical and electrical units are arranged, it is possible to obtain a watertight electronic unit protected from damp, independent replacement in a simple manner of both units, and the visualization of the indicator rod's position and movement.

15 Claims, 12 Drawing Sheets

REMOTE CONTROL DEVICE FOR CONTROLLING THE ANGLE OF INCLINATION OF THE RADIATION DIAGRAM ON AN ANTENNA

RELATED APPLICATIONS

This application is a 371 of PCT/ES06/70197 filed Dec. 19, 2006, the contents of which are incorporated herein by reference.

OBJECT OF THE INVENTION

The object of the present invention is a remote control device for adjusting the slope angle of the radiation diagram of an antenna. The control device consists of an electromechanical device which carries out the necessary actions to produce a modification in the inclination of the radiation of a variable inclination antenna for cellular communications.

The antenna on which the remote control device which is the object of the invention is installed comprises one or various transmitters and is provided with at least one phase converter, all of which is housed in a protective casing.

The device is characterised by the fact that it may be incorporated in the antenna arrangement from its original assembly or it may be attached later as an optional unit coupled to the radiation adjustment control.

The remote control device is characterised by the fact that it comprises two connected units forming a whole, with all the units being replaceable separately, maintaining the visual indication of the antenna inclination made by the indicator rod of the activation element, despite the fact that the electromechanical device which is the object of the invention is coupled to the antenna.

Therefore, the present invention is circumscribed within the scope of the antenna sector and in particular within field of devices used for modifying the slope angle of the radiation diagram of antennas in a remote manner.

BACKGROUND TO THE INVENTION

To date, electromechanical devices are known connectable to mobile telephone base station antennas for modifying the slope angle of the radiation such as those described in EP 1356539 B1. This document describes an electromechanical remote control device corresponding to a mobile telephone antenna comprising an electric motor and an electronic control housed in a single cover separated from the protective casing of the antenna components. Housed within the same casing where the motor and electronic controls are located, there is an actuator elements which passes through the interior of the protective casing of the antenna components through a perforation.

To date electromechanical devices are known connectable to mobile telephone base station antennas for modifying the slope angle of the radiation such as those described in EP 1356539 B1. Housed in the same casing which holds the motor and the electronic control, is an activation element which crosses the interior of the protective housing of the antenna elements through a perforation.

Prior to the use of an electromechanical device such as that described in patent EP 1356539 B1, what was known as an actuating element served as an indicator rod of the slope of the radiation diagram given to the antenna by means of a knob acting as a wheel or manual control actuator which acted on the phase shifters.

With a single casing which totally encloses the electric motor, the electronic control and the actuating element, there is no means of directly observing the rod's indication or its movement, and therefore it is necessary to remove the casing in order to access the interior and visualise the marking on the rod. Withdrawal of the casing produces a loss in calibration of the measurement indicated by the device, requiring a new calibration every time the casing is removed.

Similarly, through the perforation where the actuating element accesses the interior of the antenna, water and damp may filter into the casing interior housing the motor and the electronic circuit, rendering the electromechanical remote control arrangement inoperative or damaged.

Also, it may be necessary to substitute the electronic control for another electronic control arrangement either due to updates or improvements to the control equipment (hardware or software) or because the electronic circuit has stopped working. In this replacement operation the casing is removed, the circuit changed and the casing subsequently remounted. When these operations need to be carried out on numerous antennas costs can be high due to the need to carry out this operation in the factory.

Therefore, in order to overcome the aforementioned disadvantages a remote control device has been invented which is the object of the invention, with which it is possible to protect the electronic control from possible faults or defects deriving from damp filtering through the perforation through which the actuating element penetrates the interior of the antenna. Furthermore, a control device has been designed which permits easy substitution of the electronic control in a simple manner at the site of operation, where, in addition, it is possible to directly visualise the position of the indicator bar associated with the actuating element as well as its movement.

DESCRIPTION OF THE INVENTION

The invention of a device for remote control of the slope angle of the radiation diagram of an antenna enables the radiation beam of an antenna to be modified in a remote manner, permitting its incorporation at its source of origin in the factory, or it may also be added later as an optional device coupled to the actuation knob or manual control, adjusting the slope of the radiation diagram of the antenna.

The electromechanical remote control device consists of two units, one electronic and one mechanical, physically separated and connected, forming a single piece of equipment where each of the units has an independent casing or box enabling substitution or replacement of each of the units in an independent manner.

The mechanical unit comprises two parts, on one hand an electric motor, and on the other a reducer, both interconnected.

The electric motor is a brushless motor whose outlet axis is coupled to driving gear, engaged with a gear wheel and which is internally designed to house the original manual control for adjusting the inclination of the antenna. The reducer enables transfer of a specific rotation to the manual control in order to achieve a specific slope of the radiation angle. This action was previously carried out manually and is now done remotely.

In a possible embodiment the mechanical unit formed by the electromotor and the reducer is housed inside a casing comprising two parts, in the interior of which a space is defined which supports the electromotor and the reducer and a coupling to the manual control of the antenna originally used for the manual adjustment of the slope angle of radiation.

In another possible embodiment the electromotor is embedded in the casing or box of the electronic unit, supported by the mechanical unit reducer which is situated outside the electronic unit casing.

An indicator rod for the antenna inclination runs through the gear wheel and the manual control and out again and thus its position and movement is directly viewable, having previously removed a protective casing which provides protection against external agents (ice, water etc) and which is easily removable.

The connection between the mechanical and the electronic unit is made by means of a cable and connector which is protected inside the casing.

In the event that the mechanical unit is housed inside a casing, the connection with the electronic unit is made through a window or opening which connects both units. The window is appropriately closed by means of a sealing joint.

In the event that the electromotor is embedded in the electronic casing, the connection between both units is also made using a cable and connector, however in this case the connection is housed inside the casing of the electronic unit.

The electronic unit comprises supply and communication connectors, an electronic printed circuit for communications, motor energy supply and control, a reader of the initial slope and a casing with sealing joints.

The electronic printed circuit comprises means for conditioning the energy supply, as well as protective means comprising gas discharger, varistors and transitory suppressors arranged between the supply or communications lines of the casing or main body. The circuit is run by a microcontroller or microprocessor which is responsible for:

- generating six signals to the outlet bridge which supply the motor at the correct sequence.
- Reading of the internal position of the coils obtained through three Hall effect sensors included in the motor. The pulses read are also used to record the position of the indicator rod and therefore the slope of the angle of radiation of the antenna.
- Generation of information relating to the operating conditions, and protection and supervision and the alarm.
- Transmission of the remote controller and execution of the commands received from the controller.

For the purpose of initiating and taking reference of a known position of the slope angle of the antenna, it is necessary to carry out an automatic calibration procedure consistent with turning the manual control actuator for varying the slope of the antenna until the end of the indicator rod passes through a known position. This step is detected by a reader of the initial inclination or start sensor, comprising an arrangement external to the electronic unit and fixed to this electronic unit. This arrangement housing the start sensor comprises a piston which is fitted with a magnet at one of its ends.

The indicator rod when it is displaced linearly and passes through a known position corresponding to a specific inclination, in accordance with the model coupled to the control device, pushes the piston, and therefore the magnet is displaced to a Hall effect sensor arranged on the electronic circuit housed inside the electronic unit, which therefore generates an impulse which is detected by the microcontroller. All of which is possible due to the fact that the casing is made from non-magnetic material.

When the remote control device which is the object of this invention is coupled to a specific antenna model, it should be configured in the non-volatile memory of the device by means of a specific command. This configuration is in accordance with the antenna model, coupled with the objective of using a calibrated table corresponding to the antenna to which it is connected. Said calibrated table contains the reference position, the real inclination and the number of turns (pulses) required for each inclination of the antenna model selected.

The electronic circuit is also provided with protection against power surge in the motor, based on measurement of the current passing through the coils, amplifying the voltage through a resistive sensor and converting them into digital values by means of an analog-digital converter in an entry to the micro. The digital entry value, once it has been read, is comparable to a reference value and should this be exceeded, an alarm is generated and the motor energy supply is disconnected.

In addition, a resistive divisor arranged between the motor signals bus and an A/D converter entry to the micro provides the value of the entry voltage to the circuit and the motor. The micro then adjusts the width of the pulse, in accordance with the value of the entry voltage, speed, par requirements and motor specifications.

The microcontroller is programmed so that it is provided with the following modules:

- Communications module
- Module for interpretation and execution of the commands received from the remote controller,
- Supervision module of the state of the device, including generation of alarms and protections.
- Motor supply module (generation of the sequence of pulses, movement of the motor, positioning, speed, etc).
- Device configuration parameter loading module, such as for example updating of software.

DESCRIPTION OF THE DRAWINGS

In order to complete the description below and to assist in a better comprehension of its characteristics, the present descriptive report is accompanied by a set of plans with figures representing in an illustrative but not restrictive way the most significant details of the invention.

FIG. 1A shows the remote control device of a radiation diagram of an antenna comprising various transmitters and at least one phase converter and a protective casing.

PREFERRED EMBODIMENT OF THE INVENTION

In the light of the aforementioned figures, below a preferred embodiment of the invention is described with an explanation of the drawings.

The group of FIGS. 1 to 6 show a first embodiment of the invention in which the mechanical unit is arranged externally to the electronic unit although both are joined, while the group of FIGS. 7 to 11 show a second form of embodiment in which the mechanical unit is arranged partly externally to the electronic unit and partly within the electronic embodiment, with the electric motor embedded in the interior of the electronic unit.

In either of the two forms, both embodiments of the mechanical and electronic units are physically separated but connected to each other, and they may be replaced independently without having to replace the two simultaneously; the electronic unit is sealed against damp, and the indicator rod of the slope of the angle of radiation of the antenna is visible from the exterior, with its position and movement clearly seen.

Figure 1:
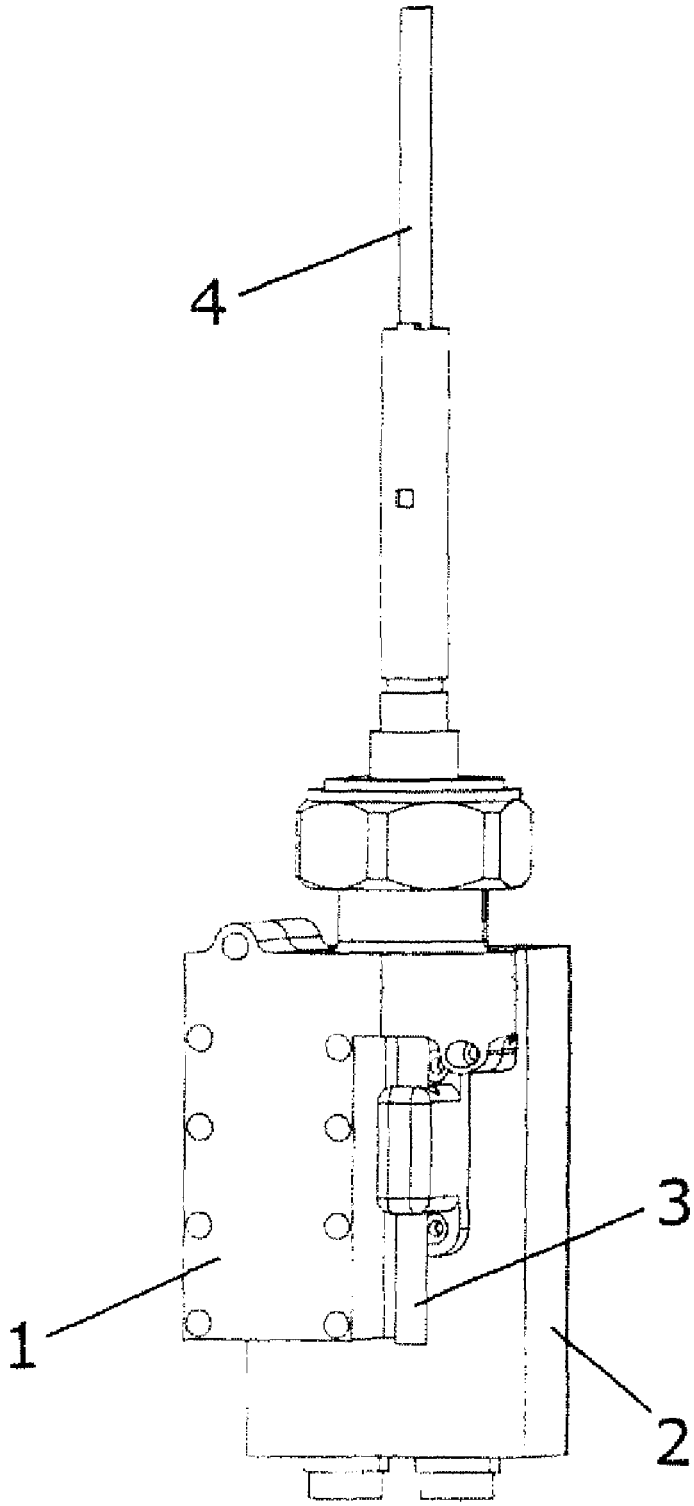
FIG. 1 shows a perspective representation of a first embodiment of the remote control device in which the two units it comprises may be observed coupled together.

FIG. 1 shows the remote control device which is the object of the invention and which comprises two units, one electric (2) and a mechanical unit (1) connected to each other and forming a single arrangement where each unit has its own casing or box. The mechanical unit (1) is crossed by the indicator rod (3) which is visualised at its lower end, whereas above the indicator rod is the actuator element (4) which enters the protective casing housing the antenna transmitter elements in order to act on a phase shifter which modifies the radiation angles.

In FIG. 1A the remote control device of a radiation diagram of an antenna comprising various transmitters and at least one phase converter (28) and a protective casing (29) is shown.

Figure 2:
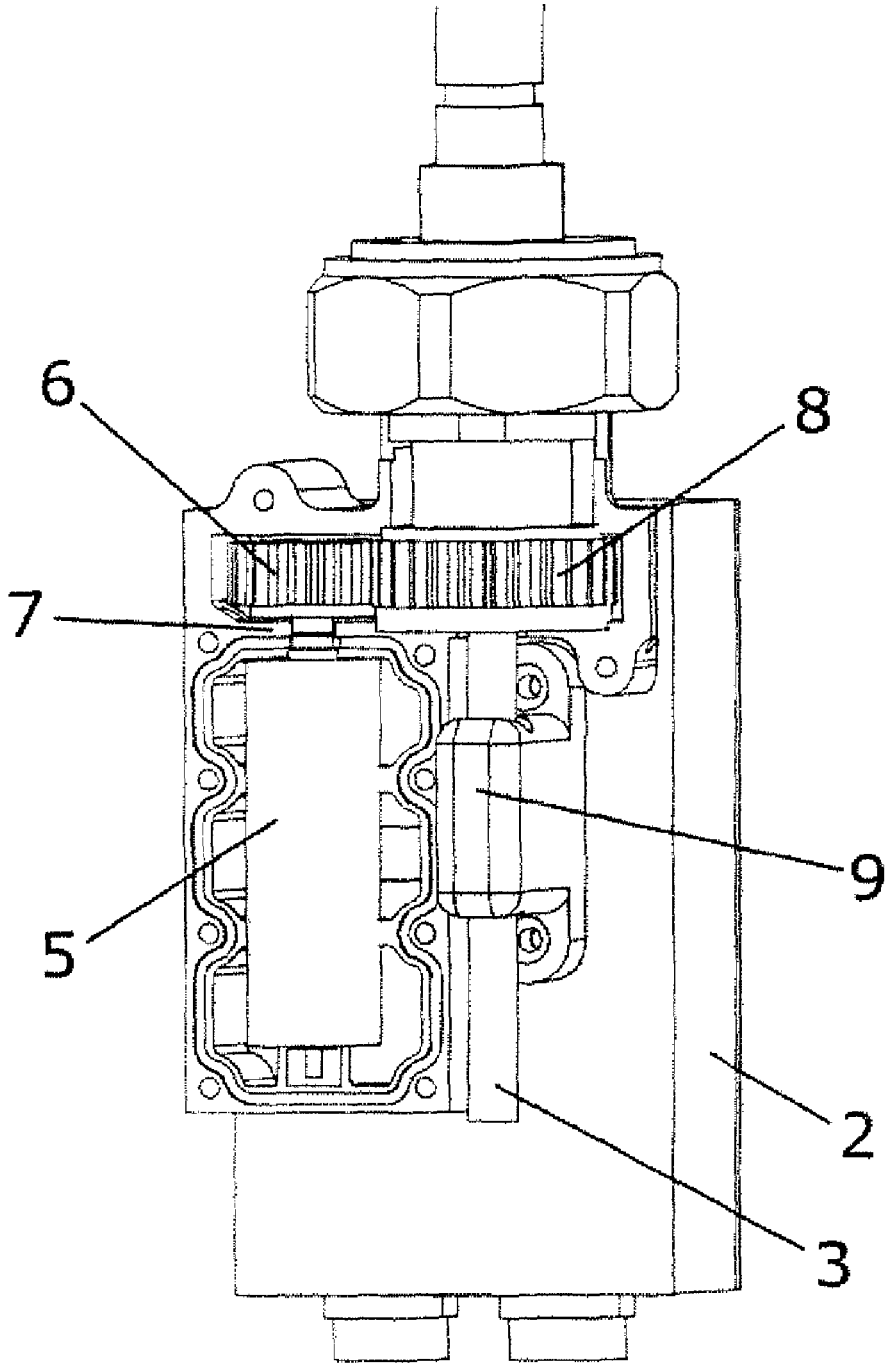
FIG. 2, shows the interior of the mechanical unit together with all the component elements in a first embodiment.

The elements which make up the mechanical unit may be seen more clearly in FIG. 2 where one of the parts of the casing holding the mechanical unit components has been removed. This figure shows the arrangement of a brushless motor (5) in the outlet axis of which a driving gear (6) is placed which engages with a cog wheel (8) designed so that there is a mechanical coupling on this wheel of the knob or manual control actuator for modifying the slope angle of the radiation.

In order to let any drops of water passing over the actuator fall downwards, the manual control cog with the internal cog wheel has a space left between some of teeth so that the water can pass downwards through this space thus avoiding the accumulation of water which could filter into other parts.

The space housing the electric motor (5) is surrounded by a seal joint (7) so that the space is sealed when the mechanical unit casings are closed.

Figure 3:
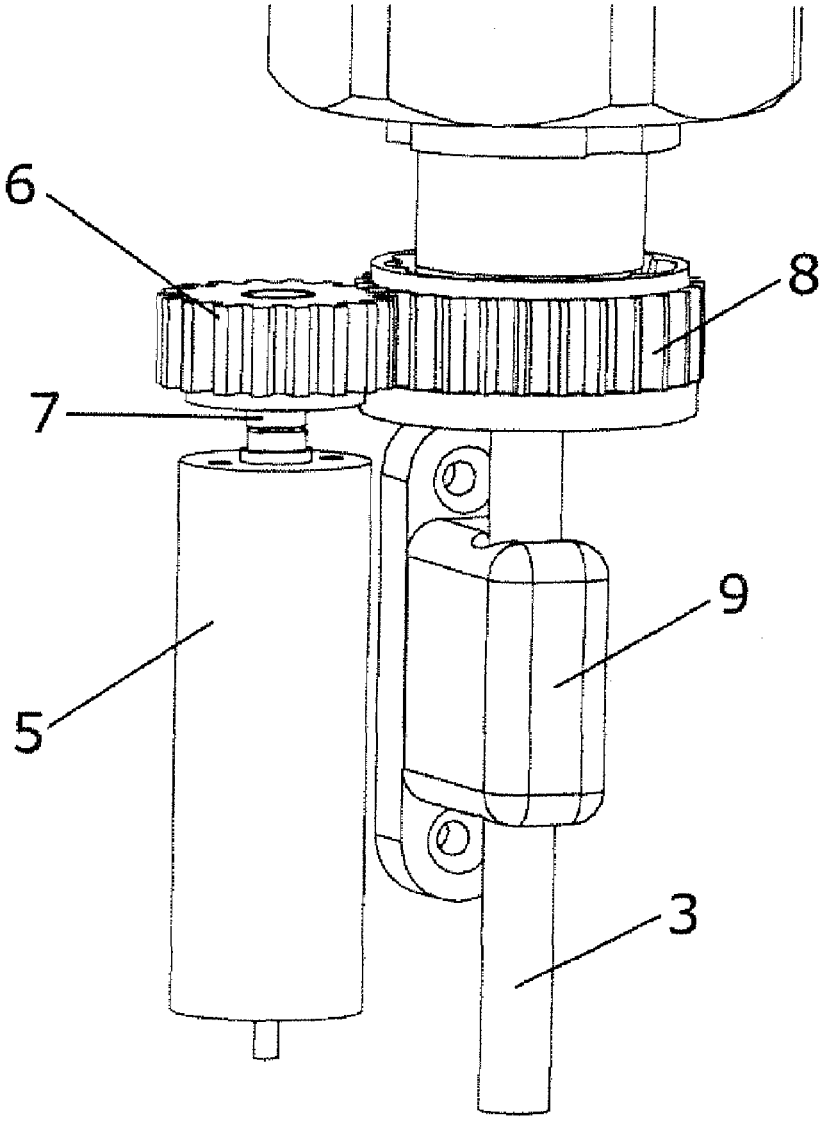
FIG. 3 shows the mechanical unit elements outside the casing where they are housed, as well as the start sensor.

FIG. 2, like FIG. 3 also shows a reader of the initial inclination (9) or start sensor through which the indicator rod passes (3). As stated previously, this initial inclination reader (9) or sensor serves for the initial calibration of the arrangement in order to take the reference of a known position corresponding to a specific inclination and which by means of the table corresponding to the antenna model to which the device is connected, it is possible to know the inclination of radiation of the antenna at all times.

Figure 4:
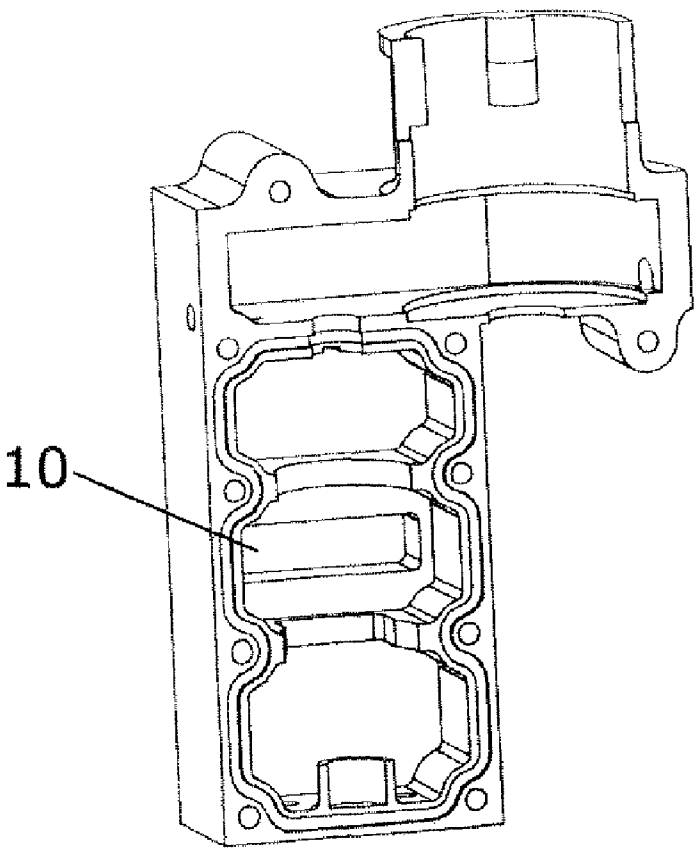
FIG. 4 shows the casing of the mechanical unit.
Figure 4:
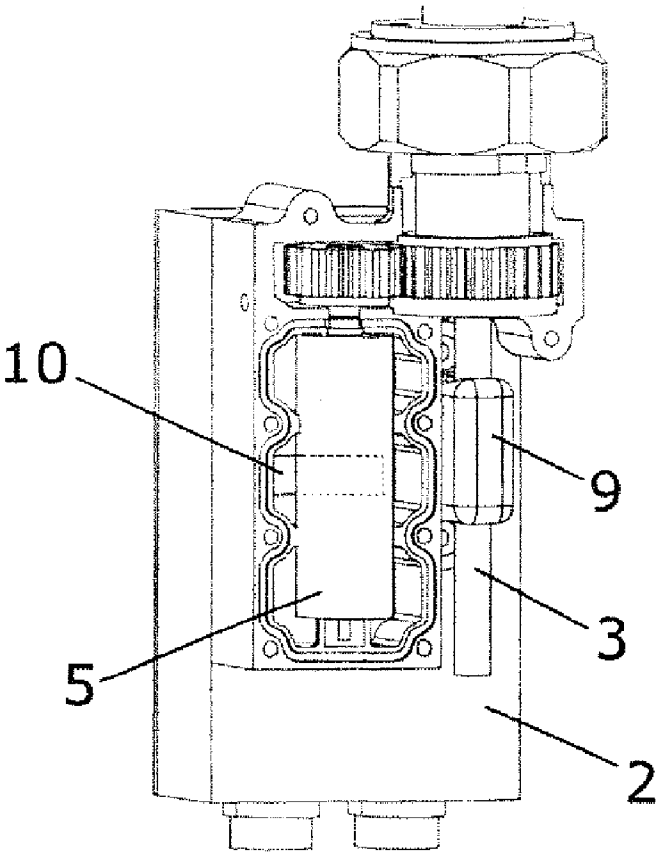
Figure 5:
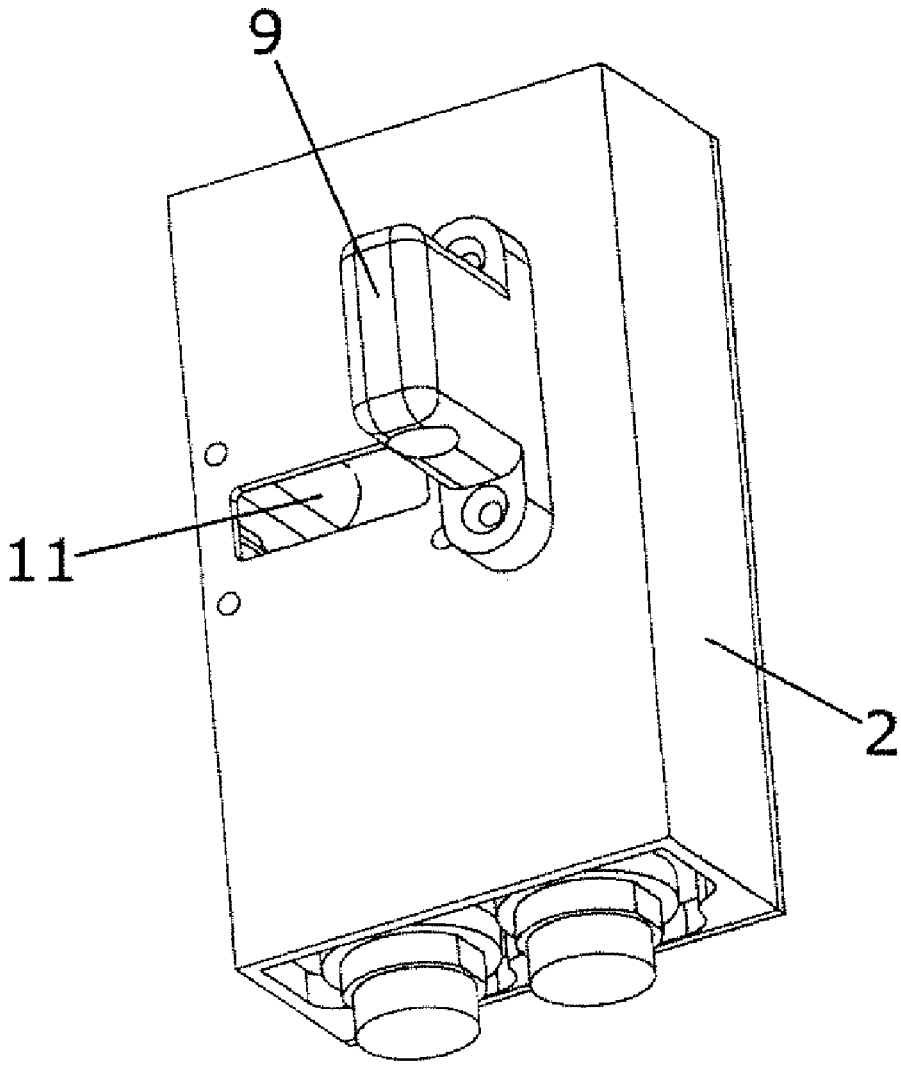
FIG. 5 shows a perspective representation of the electronic unit.

The two units, the mechanical unit (1) and the electronic unit (2) of the remote control device which is the object of the invention, although they are independent and may be replaced in an independent manner, are connected forming a single arrangement. In order for the supply and signal cables to pass through one of the parts which makes up the mechanical casing is provided with a window (10) (FIG. 4). This window (10) corresponds to the window (11) inserted on one of the parts which make up the casing of the electronic unit (2) (FIG. 5). Obviously these windows (10) and (11) are provided with a waterproof seal, in order to prevent dust, or damp etc passing through.

The connection between the mechanical unit (1) and the electronic unit (2) is made with a cable which crosses the windows or openings, by means of a multipin connector.

Figure 6:
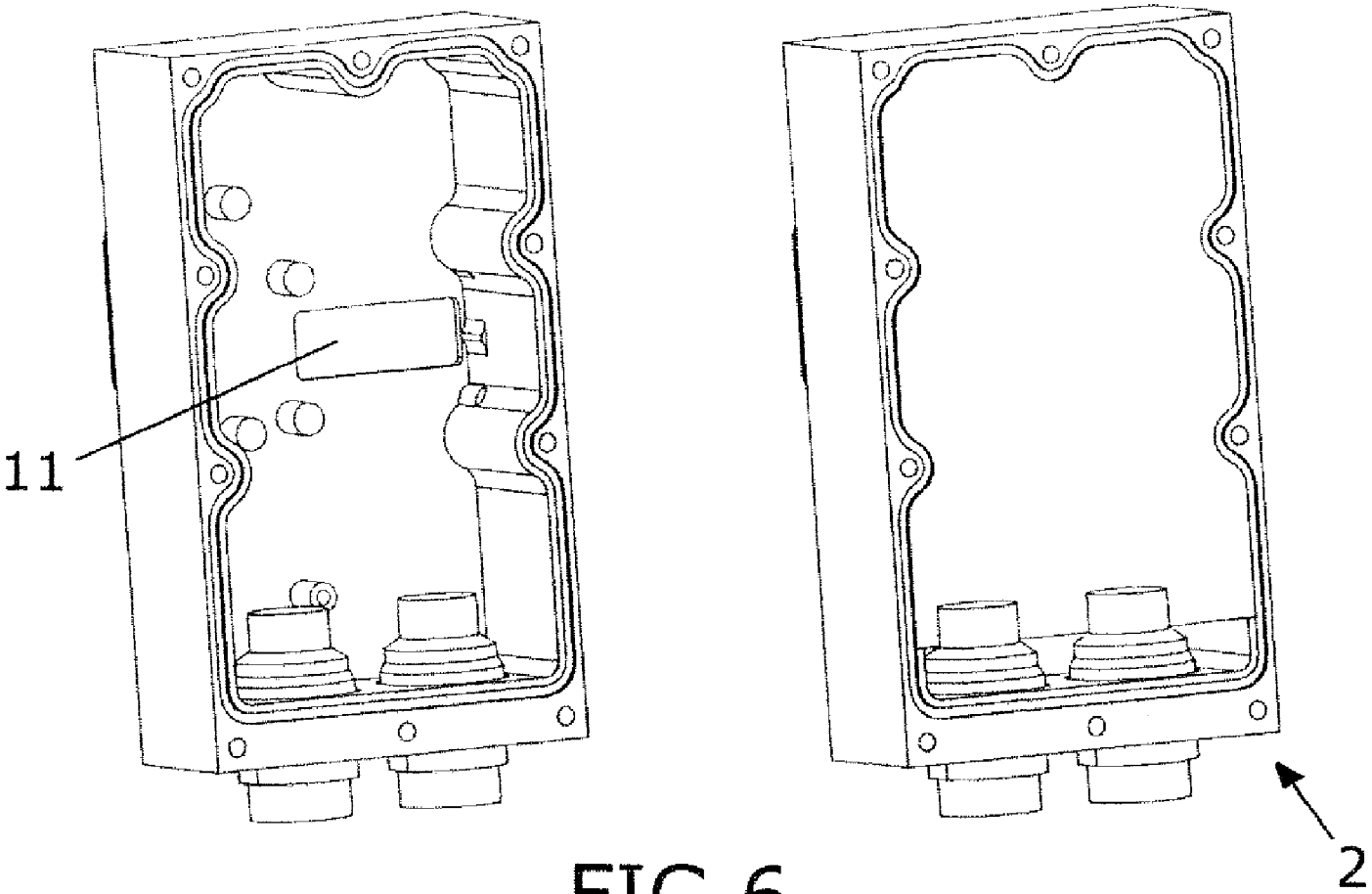
FIG. 6 shows the casing of the electronic unit.
Figure 7:
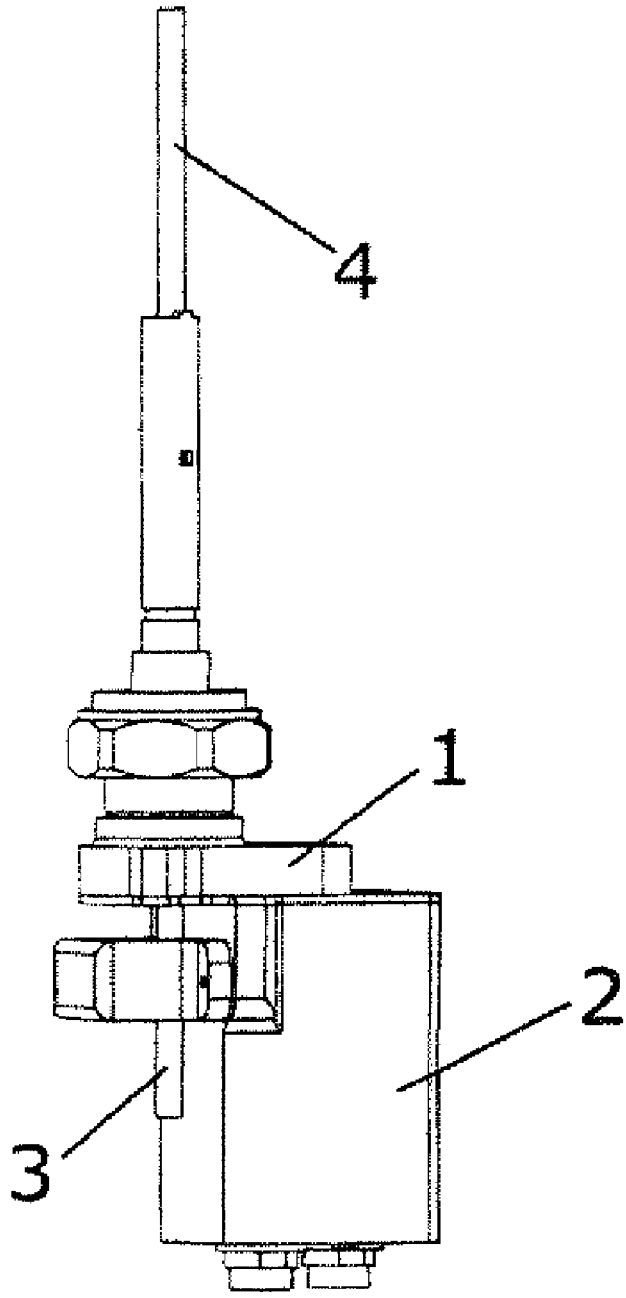
FIG. 7 shows a perspective representation of a second embodiment where the electric motor of the mechanical unit is embedded in the electronic casing.
Figure 8:
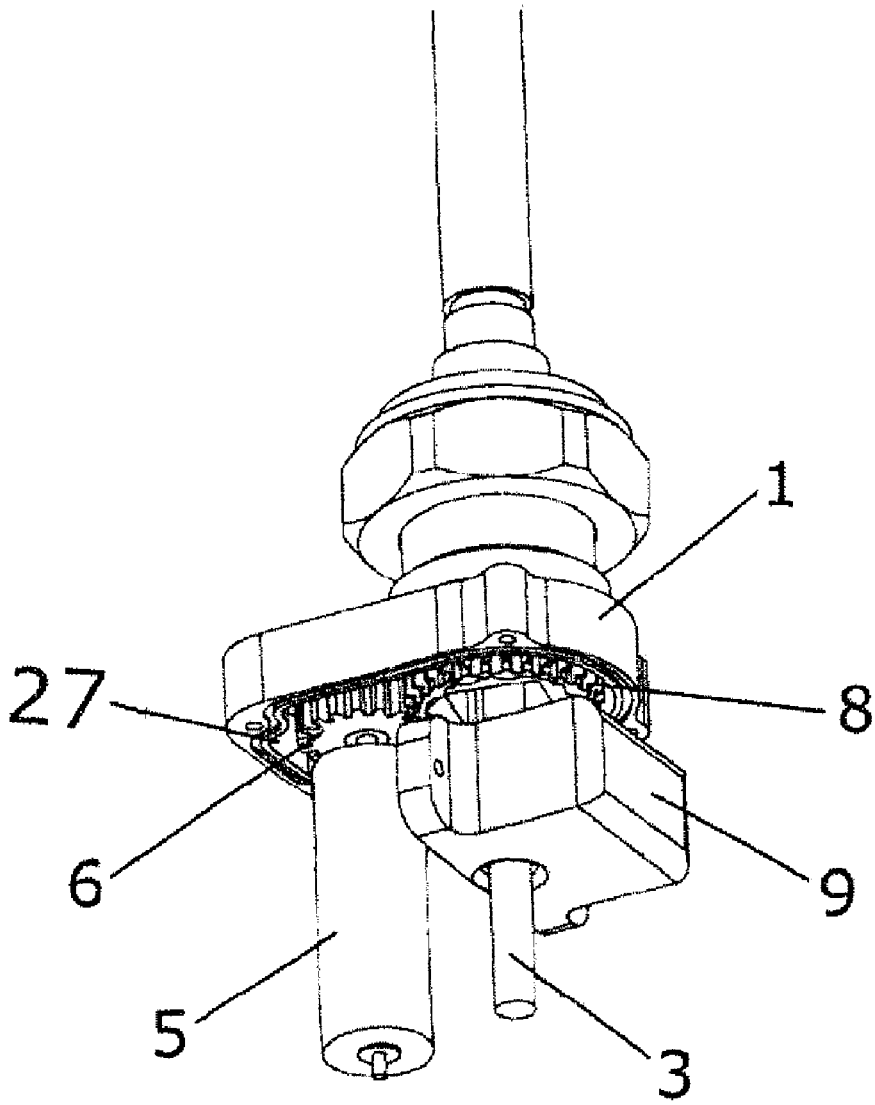
FIG. 8 shows a representation of a second embodiment where the elements of the mechanical unit are noted.

FIG. 6 shows in a clearer manner the two parts which comprise the casing of the electronic unit.

FIGS. 7 to 11 show a second embodiment. Specifically FIG. 7 clearly shows the mechanical unit (1) connected to the electronic unit where only part of said mechanical unit is external to the electronic unit, since, as may be seen in FIG. 8, whereas the reducer (27) arrangement of the mechanical unit is outside the electronic casing, the electric motor (5) is embedded in the interior of the electronic casing.

Despite the fact that the electric motor (5) is within or embedded within the electronic casing, this does not prevent the electronic unit from being watertight to the exterior and the fact that both units may be treated differently that is, one unit may be replaced by another similar one without any need to change both units.

Figure 9:
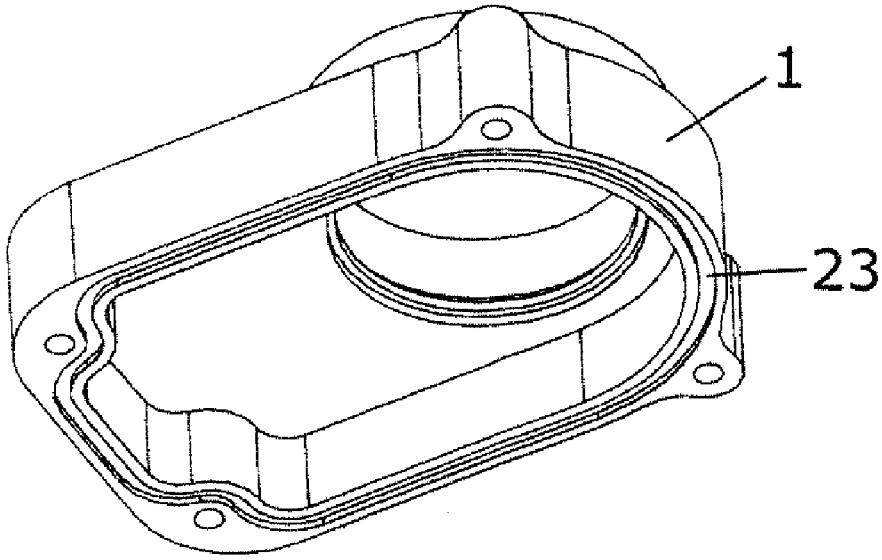
FIG. 9 shows a detailed view of the reducer unit casing of the second embodiment.

FIG. 9 shows the unit casing which houses the reducer (27) of the mechanical unit, where it is possible to see the sealing joint (23) arranged on its lower edge, with the aim of achieving watertightness with respect to the rest of the arrangement.

Figure 10:
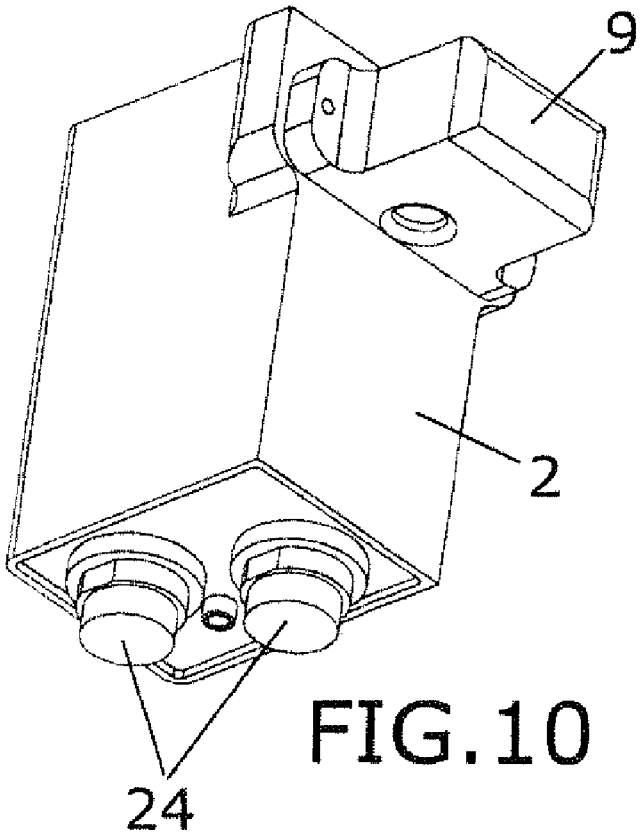
FIGS. 10 and 11 show various views of the casing of the electronic unit in this second embodiment.
Figure 11:
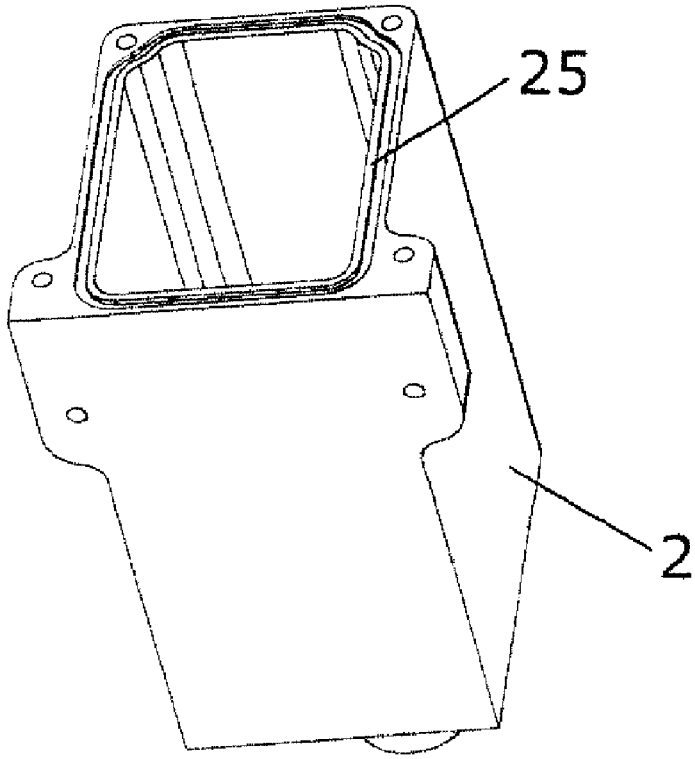

FIGS. 10 and 11 respectively show a lower and upper view of the casing of the electronic unit, in this second embodiment the lower connectors (24) are highlighted, while in the upper part the arrangement of a sealing joint (25) designed to ensure internal watertightness is prominent.

Figure 12:
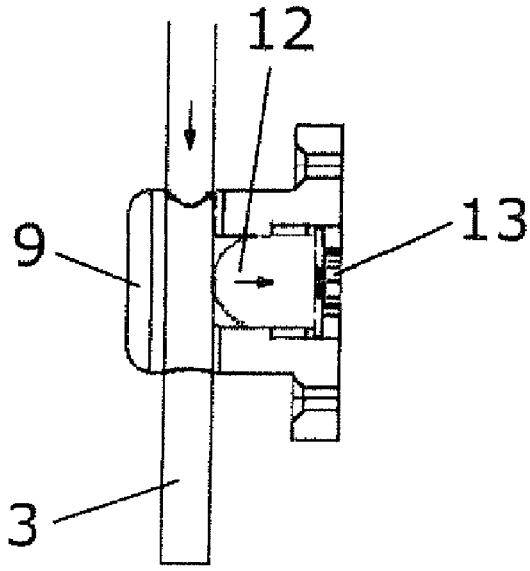
FIG. 12 shows the start sensor.

As may be seen from FIGS. 10 and 11, the casing corresponding to this second embodiment does not have any connection window, however, the connection between the mechanical unit and the electronic unit is made in the internal part of the casing by means of a cable and a multipin connector FIG. 12 shows details of the reader of the initial inclination (9) or start sensor which comprises an arrangement external to the electronic unit and fixed to this electronic unit (2). This arrangement housing the inclination reader or start sensor comprises a piston (12) which is fitted with a magnet (13) at one of its ends. When the indicator rod (3) crossing to the reader of the initial inclination or start sensor (9) passes through a specific position, it pushes the piston (12) which displaces the magnet (13). This magnet is placed in front of a Hall effect sensor arranged on the electronic circuit generating a pulse which is received by the microcontroller. The electronic unit casing in both forms of the embodiment is made from non-magnetic material so that the pulse cannot pass through it.

Figure 13:
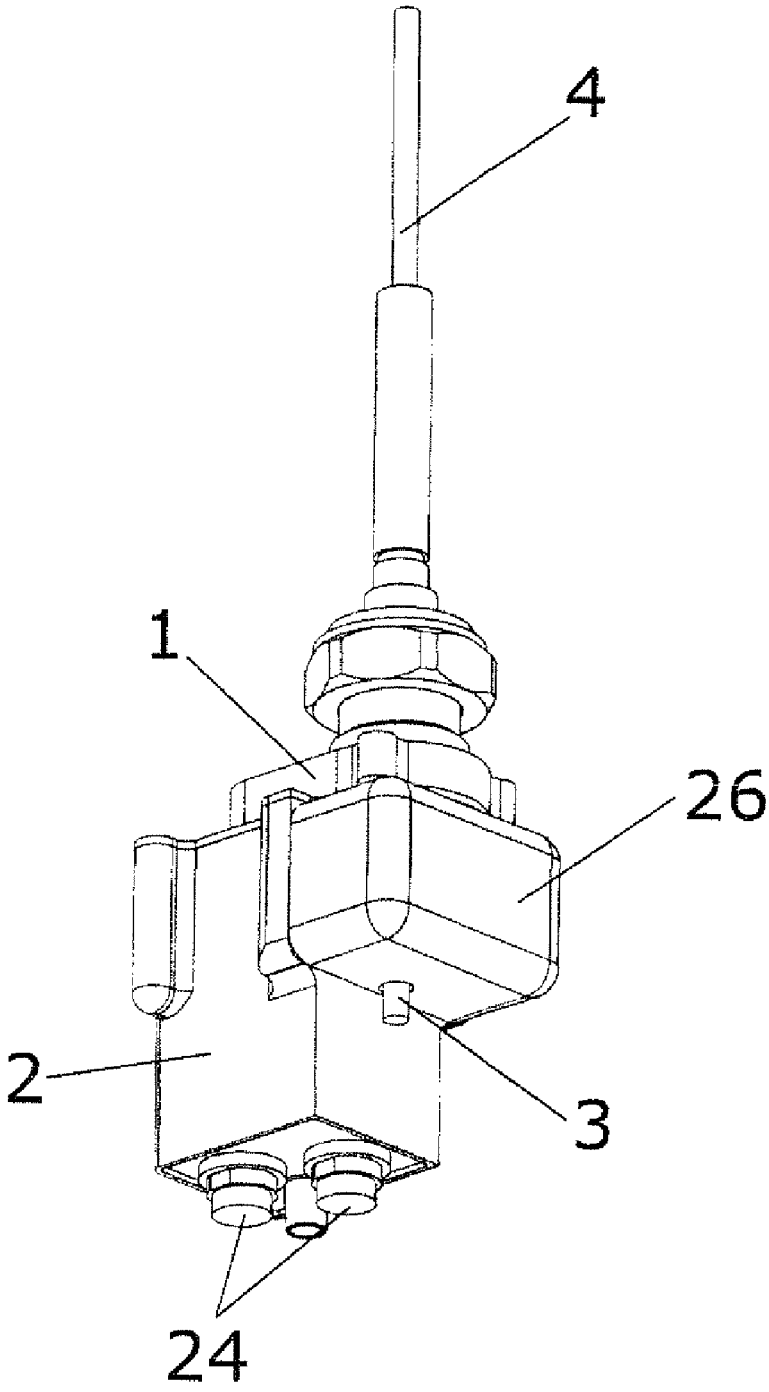
FIG. 13 shows a perspective view of the device which is the object of the invention showing the protective casing of the indicator rod of the inclination of the radiation diagram of the antenna.

FIG. 13 shows the whole arrangement of the device which is the object of the invention highlighting the arrangement of a protective casing (26) covering the indicator rod (3) so that this indicator rod (3) is protected against external agents such as ice, water etc. with removal of the casing being a simple operation.

Figure 14:
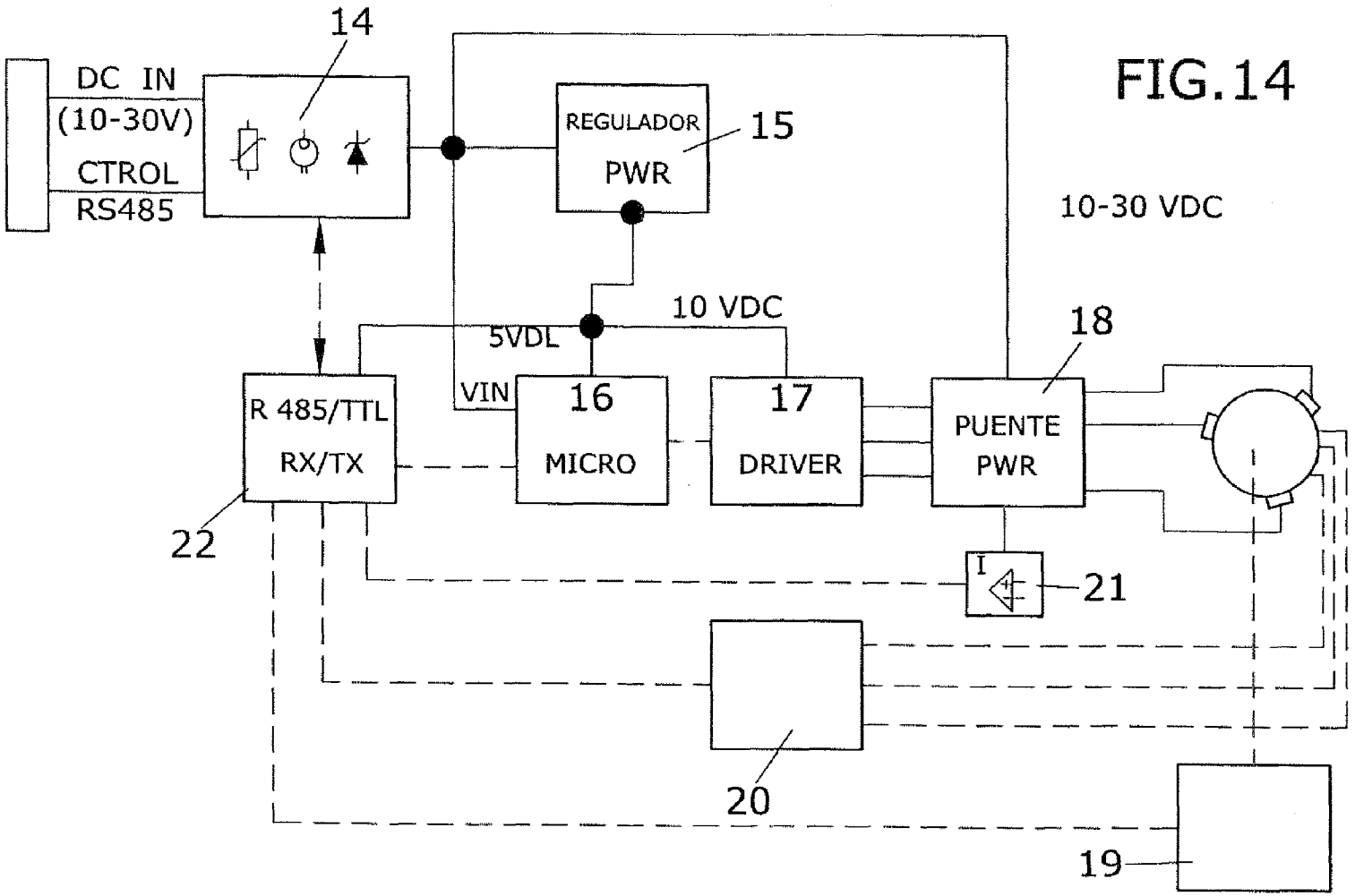
FIG. 14 shows a diagrammatic view of the main modules or elements which make up the electronic circuit located inside the electronic unit.

Finally, FIG. 14 shows the diagram of blocks of the components which make up the electronic circuit housed in the interior of the casing of the electronic module (2). The electronic circuit has as external connections a supply connection which is continuously supplied with between 10-30 volts, and another serial transmission connection which could, for example, be a RS485 connection.

In order to protect the electronic circuit from the electricity or power surges which could enter the circuit, between the supply and communication connections and the mass or earth, protective means are provided (14) which may be gas dischargers, varistors and transitory suppressers etc. The food supply received is duly conditioned by means of a voltage conditioner (15) which adapts the entry voltage to the supply voltage of some elements of the circuit.

The circuit is governed by a microcontroller or microprocessor (16) which controls the pulse sequence to be provided to an outlet bridge (18) through an outlet driver (17). The bridge (18) supplies the width modulated current pulses duly sequenced to each of the coils of the motor.

Furthermore, the information relating to the positioning of the motor coils is obtained due to means indicating the positioning of the coils, which may be executed by means of three Hall effect sensors included in the motor, or either by means of provision of the state of conditioning of the electromotor forces generated in the non excited coils achieving a control of the positioning of the coils without sensors.

The information relating to the positioning of the coils is sent to the microprocessor by means of a conditioner (20) of the signal from the rotation sensors. The circuit also has means of protection against power surges, consistent with a module (21) which measures the current and a converter of the value reading to a digital one for its introduction in the microprocessor (16). The value read by the microprocessor is compared to a threshold value and should this be exceeded, the microprocessor generates an alarm and disconnects the feed from the motor.

The information relating to a reference point is obtained from the Hall effect sensor (19), which, following a reading of an initial position from a known position permits the arrangement to be initialised.

Finally, the circuit is provided with a transmitter/receiver circuit (22) used as a communications interface between the exterior and the microprocessor (16).

This description is sufficient for any expert in the art to understand the scope of the invention and the advantages deriving therefrom.

The materials, form, size and arrangement of the elements may be varied, provided they do not alter the essential nature of the invention.

The terms of this report should always be taken in the broadest and not the most restrictive sense.

The invention claimed is:

1. Remote control device for the slope angle of a radiation diagram of an antenna in which the antenna comprises various transmitters and at least one phase converter, and a protective casing, and in which by means of moving the at least one phase converter, it is possible to adjust a different slope angle of the radiation diagram with the transmitters and the at least one phase converter housed in the interior zone of the protective casing; the control device comprises an electric motor and an electronic unit, characterised in that the electric motor forms part of a mechanical unit (1), which is connected to an electronic unit, both units being physically separated and electrically connected forming a sole arrangement, with said units being replaceable independently, and in which an actuator element (4) of the control device moves or acts on an indicator rod (3) wherein the indicator rod's length is visualised from outside of the units, thus indicator rod's position and movement can be viewed.

2. Remote control device of the slope angle of the radiation diagram of an antenna according to claim 1 characterised in that the mechanical unit (1) comprises a casing formed by two parts in the interior of which the electric motor (5) is supported, on whose outlet axis a driving gear (6) is arranged, on which a gear wheel is engaged (8) designed in such a way that on this wheel the mechanical coupling is produced of the knob or manual actuation control for modifying the slope angle of the radiation of the antenna.

3. Remote control device for the slope angle of the radiation diagram of an antenna according to claim 2, characterised in that a space where the electric motor is housed (5) is surrounded by a sealing joint (7) in such a way that said space is sealed when the two parts of the mechanical unit casing are closed.

4. Remote control device for the slope angle of the radiation diagram of an antenna according to claim 3 characterised in that the mechanical unit (1) comprises a casing which has two parts, with one of the parts provided with a window (10) or opening which forms a watertight connection between both units, window through which the connection between the mechanical unit and the electrical unit is made.

5. Remote control device for the slope angle of the radiation diagram of an antenna according to claim 1 characterised in that the mechanical unit is formed by a reducer (27), arranged externally to the electronic unit, which supports the electric motor housed inside the electronic unit; the reducer presents a driving gear (6) on which a toothed wheel (8) is engaged.

6. Remote control device of the slope angle of the radiation diagram of an antenna according to claim 1 characterised in that the electronic unit (2) consists of supply and communication connectors, an electronic printed circuit for communications, energy supply and control of the motor, an inclination reader (9) of the initial inclination and a casing.

7. Remote control device for the slope angle of the radiation diagram of an antenna according to claim 4, characterised in that the casing of the electronic unit (2) has two parts, on one of which parts a window or opening (11) is provided, which as the two mechanical (1) and electronic (2) units connect, the windows or openings (10) and (11) face each other and serve for the transit of the connection cables and with said window sealed by means of a sealing joint.

8. Remote control device for the slope angle of the radiation diagram of an antenna according to claim 5, characterised in that a casing of the electronic unit (2) presents a closed form except for an opening through which the electric motor is introduced into the casing of the electronic unit, making the connection with the mechanical unit by means of a cable and connector with said opening having a sealing joint.

9. Remote control device the slope angle of the radiation diagram of an antenna according to claim 1 characterised in that the interior of a electronic unit casing (2) houses an electronic circuit.

10. Remote control device of the inclination angle of the radiation diagram of an antenna according to claim 6, characterised in that the device has a reader indicating the initial position (9) through which the indicator rod (3) passes and which serves for the initialisation and reference taking of a known position.

11. Remote control device for the slope angle of the radiation diagram of an antenna according to claim 10, characterised in that the indicator reader of the initial position (9) comprises an arrangement external to the electronic unit and fixed to this electronic unit, being formed by a piston (12) which is provided with a magnet on one of its ends (13).

12. Remote control device for the slope angle of the radiation diagram of an antenna according to claim 9, characterised in that the electronic circuit housed in the electronic unit is provided with:

a microprocessor (16), some external supply and communications connections, a module conditioning the supply voltage (15), means for protection (4) against power surges and voltages, a bridge (18) which generates energy pulses to the motor coils, a driver (17) which conditions the signal of the microprocessor (16) in order to generate switch signals of the bridge elements (18), a transmitter/receiver circuit (22) which serves as a communications interface between the exterior and the microprocessor (16), a module (20) which conditions the signal from the rotation sensors, a sensor (19) for recognition of an initial or reference position, and a module (21) measuring the power supplied to the motor coils.

13. Remote control device for the slope angle of the radiation diagram of an antenna according to claim 12, characterised in that the means of protection against power surges are connected between the power inlet and a reference or earth, being formed by some or various of the elements such as gas dischargers, varistors and transitory suppressers etc.

14. Remote control device for the slope angle of the radiation diagram of an antenna according to claim 12, characterised in that the sensor (19) for recognising an initial position or reference is made by means of a Hall effect sensor arranged on an electronic circuit and placed closely to a magnet (13) of the reader of the initial inclination or start sensor (9).

15. Remote control device for the slope angle of the radiation diagram of an antenna according to claim 1, characterised in that the indicator rod (3) is provided with the protective casing (26) to protect against external environmental agents.

* * * * *

UNITED STATES PATENT AND TRADEMARK OFFICE

CERTIFICATE OF CORRECTION

PATENT NO. : 7,812,776 B2
APPLICATION NO. : 11/996366
DATED : October 12, 2010
INVENTOR(S) : Ramon Guixa Arderiu It is certified that error appears in the above-identified patent and that said Letters Patent is hereby corrected as shown below:

IN THE CLAIMS:

Column 7, line 66 claim 1: insert the word --the-- after thus and before indicator;

Column 8, line 52 claim 9: insert the word --for-- after device and before the slope; and Column 8, line 54 claim 9: “interior of a” should read “interior of an”

Signed and Sealed this
Twenty-second Day of November, 2011

David J. Kappos

David J. Kappos
*Director of the United States Patent and Trademark Office*